US007748262B2

(12) United States Patent
Reginaldo et al.

(10) Patent No.: US 7,748,262 B2
(45) Date of Patent: Jul. 6, 2010

(54) COOLANT FLOW MEASUREMENT DEVICES AND METHODS OF MEASURING COOLANT FLOW

(75) Inventors: Alberto Nerida Reginaldo, Orchard Lake, MI (US); Linda Celina Ward, Oakland Township, MI (US); Richard Gene Lowhorn, Belleville, MI (US); Matthew Noppenberger, Holly, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 104 days.

(21) Appl. No.: 12/248,227

(22) Filed: Oct. 9, 2008

(65) Prior Publication Data

US 2010/0089170 A1 Apr. 15, 2010

(51) Int. Cl.
*G01M 15/00* (2006.01)
*G01M 19/00* (2006.01)
*G01F 1/00* (2006.01)

(52) U.S. Cl. ..... 73/114.68; 73/114.77; 73/116.01; 73/861; 123/41.01

(58) Field of Classification Search ..... None
See application file for complete search history.

(56) References Cited

U.S. PATENT DOCUMENTS

| | | | | |
|---|---|---|---|---|
| 3,292,427 | A | 12/1966 | Mattson | |
| 4,062,231 | A | 12/1977 | Mercik, Jr. et al. | |
| 4,574,747 | A | 3/1986 | Hirano | |
| 4,916,941 | A | 4/1990 | Briggs | |
| 5,031,579 | A * | 7/1991 | Evans | 123/41.2 |
| 5,291,142 | A | 3/1994 | Ohmi | |
| 5,675,259 | A | 10/1997 | Arndt et al. | |
| 6,678,628 | B2 * | 1/2004 | Ryan et al. | 702/132 |
| 7,069,883 | B2 | 7/2006 | Atkins | |

* cited by examiner

*Primary Examiner*—Harshad Patel
(74) *Attorney, Agent, or Firm*—Dinsmore & Shohl LLP

(57) ABSTRACT

A coolant flow measurement device includes a coolant flow circuit, a cooling system, a purge system, a variable speed fluid pump, a differential pressure gage and a primary flow meter. The coolant flow circuit may be attached to a an HVAC system of the vehicle such that coolant may be circulated through the HVAC system of the vehicle. The cooling system may cool the coolant in the coolant flow circuit. The purge system may be used to purge air from the coolant flow circuit. The variable speed fluid pump may be operable to balance the fluid pressure between the device inlet and the device outlet. The primary flow meter may be operable to measure the coolant flow in the coolant flow circuit. The differential pressure gage measures a pressure differential between the device inlet and the device outlet.

20 Claims, 5 Drawing Sheets

COOLANT FLOW MEASUREMENT DEVICES AND METHODS OF MEASURING COOLANT FLOW

TECHNICAL FIELD

The present invention generally relates to devices and methods for measuring coolant flow through a vehicle HVAC system and, more specifically, to a bench test device for measuring coolant flow through a vehicle HVAC system and methods for performing coolant flow measurement.

BACKGROUND

During the design or characterization of a vehicle HVAC system it may be necessary or desirable to measure the flow of cooling fluid or coolant through a particular component of the HVAC system. For example, it may be necessary to measure the flow of coolant through the radiator, the engine and/or the heater core(s) of the vehicle. In order to obtain an accurate coolant flow measurement, the pressure at the inlet of the HVAC system (e.g., at the point where the outlet of the flow meter attaches to the HVAC system) and the pressure at the outlet of the HVAC system (e.g., at the point where the inlet of the flow meter attaches to the HVAC system) must be balanced such that both the inlet pressure and the outlet pressure are the same. A variety of factors may effect the inlet pressure and outlet pressure of the HVAC system including air trapped in the HVAC system and debris and/or corrosion products flowing through the HVAC system. Air trapped in the HVAC system is particularly problematic when balancing the inlet and outlet pressures of the HVAC system.

Current devices for measuring coolant flow do not provide a mechanism by which air may be easily and reliably purged from the HVAC system and/or the coolant flow measurement device. Further, the current systems and devices currently used to measure coolant flow do not provide for balancing the pressure between the inlet and the outlet of the HVAC system. Accordingly, the coolant flow measurements obtained with such systems and devices may not provide accurate, repeatable measurements on a consistent basis.

Accordingly, a need exists for alternative devices and methods for measuring the coolant flow through a vehicle HVAC system.

SUMMARY

According to one embodiment shown and described herein, a coolant flow measurement device for measuring the flow of coolant through the HVAC system of a vehicle includes a coolant flow circuit, a cooling system, a purge system, a variable speed fluid pump, a differential pressure gage and a primary flow meter. The coolant flow circuit includes a device outlet operable for attachment to an engine coolant flow inlet of the vehicle and a device inlet operable for attachment to a front heater core outlet of the vehicle such that coolant may be circulated from the coolant flow circuit into the engine coolant flow inlet, through the HVAC system of the vehicle and back into the coolant flow circuit. The cooling system may be fluidly connected to the coolant flow circuit proximate the device inlet such that coolant flowing into the device inlet passes through the cooling system, wherein the cooling system may be operable to regulate the temperature of the coolant flowing through the coolant flow circuit. The purge system may be fluidly connected to the coolant flow circuit such that coolant flowing through the coolant flow circuit may be diverted into the purge system and back into the coolant flow circuit, wherein the purge system may be operable to purge air from the coolant flow circuit. The variable speed fluid pump may be fluidly connected to the coolant flow circuit such that coolant flowing through the coolant flow circuit passes through the variable speed fluid pump, wherein the variable speed fluid pump may be operable to balance a pressure of the coolant between the device inlet and the device outlet. The primary flow meter may be fluidly connected to the coolant flow circuit such that coolant flowing through the coolant flow circuit passes through the primary flow meter, wherein the primary flow meter may be operable to measure a flow rate of coolant flowing through the coolant flow circuit. The differential pressure gage may be fluidly connected to the coolant flow circuit proximate the device inlet and the device outlet, wherein the differential pressure gage may be operable to measure a pressure differential between the device inlet and the device outlet.

In another embodiment shown and described herein, a coolant flow measurement device for measuring the flow of coolant through the HVAC system of a vehicle includes a coolant flow circuit, a purge system, a radiator, a cooling fan a temperature controller, a thermocouple, a variable speed fluid pump, an electromagnetic flow meter and a differential pressure transducer. The coolant flow circuit may include a device outlet, a device inlet and a rear heater core inlet. The device outlet may be operable for attachment to the engine coolant flow inlet of the vehicle. The device inlet may be operable for attachment to the front heater core outlet of the vehicle. The rear heater core inlet may be operable for attachment to the rear heater core outlet of the vehicle such that coolant may flow from the coolant flow circuit into the engine coolant flow inlet, through the HVAC system of the vehicle and back into the coolant flow circuit. The radiator may be fluidly connected to the coolant flow circuit such that coolant flowing through the coolant flow circuit flows through the radiator. The thermocouple may be positioned in a thermocouple well disposed in the coolant flow circuit between the device inlet and the radiator and is operable to detect a temperature of the coolant flowing through the coolant flow circuit. The cooling fan may be positioned proximate the radiator and operable to provide air flow through the radiator. The temperature controller may be electrically coupled to the cooling fan and the thermocouple and may be operable to switch the cooling fan on and off based on the detected temperature of the coolant. The purge system may be fluidly coupled to the coolant flow circuit with a three-way switching valve and a one-way check valve such that fluid flowing through the coolant flow circuit may be diverted into the purge system with the three-way switching valve and coolant may flow out of the purge system and back into the coolant flow circuit through the one-way check valve. The variable speed fluid pump may be fluidly connected to the coolant flow circuit such that coolant flowing through the coolant flow circuit passes through the variable speed fluid pump, wherein the variable speed fluid pump may be operable to balance a pressure of the coolant between the device inlet and the device outlet. The electromagnetic flow meter may be fluidly connected to the coolant flow circuit such that coolant flowing through the coolant flow circuit passes through the electromagnetic flow meter, wherein the electromagnetic flow meter may be operable to measure a flow rate of coolant flowing through the coolant flow circuit. The differential pressure transducer may be fluidly connected to the coolant flow circuit proximate the device inlet and the device outlet, wherein the differential pressure transducer may be operable to measure a pressure differential between the device inlet and the device outlet.

In yet another embodiment, a method for measuring the coolant flow through an HVAC system of a vehicle with a coolant flow measurement device including a coolant flow circuit, a cooling system, a purge system, a variable speed fluid pump, a differential pressure gage and a primary flow meter, wherein the cooling system, the purge system, the variable speed fluid pump, the differential pressure gage and the primary flow meter are fluidly connected to the coolant flow circuit of the coolant flow measurement device may include connecting a device outlet of the coolant flow circuit with an engine coolant flow inlet of the HVAC system of the vehicle and connecting a device inlet of the coolant flow circuit with a front heater core inlet of the HVAC system of the vehicle. Coolant from the coolant flow circuit may be supplied to the HVAC system of the vehicle such that the coolant flows through the HVAC system of the vehicle and back into the coolant flow circuit with the variable speed fluid pump. Thereafter, air may be purged from the coolant flow circuit with the purge system of the coolant flow measurement device until the pressure differential between the device outlet and the device inlet is zero as determined by the pressure differential gage of the coolant flow measurement device. The temperature of coolant flowing through the coolant flow system may then be adjusted with the cooling system of the coolant flow measurement device to reach a desired coolant temperature. The engine of the vehicle may be revved to a desired engine speed. The speed of the variable speed fluid pump may be adjusted at the desired engine speed until the pressure differential between the device outlet and the device inlet is zero as determined by the pressure differential gage of the coolant flow measurement device. The flow rate of coolant through the coolant flow circuit may then be measured with the primary flow meter at the desired engine speed and the desired coolant temperature, wherein the measured flow rate of coolant through the primary flow circuit is the flow rate of coolant through the HVAC system of the vehicle.

These and additional features provided by the embodiments of the present invention will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION

Figure 1:
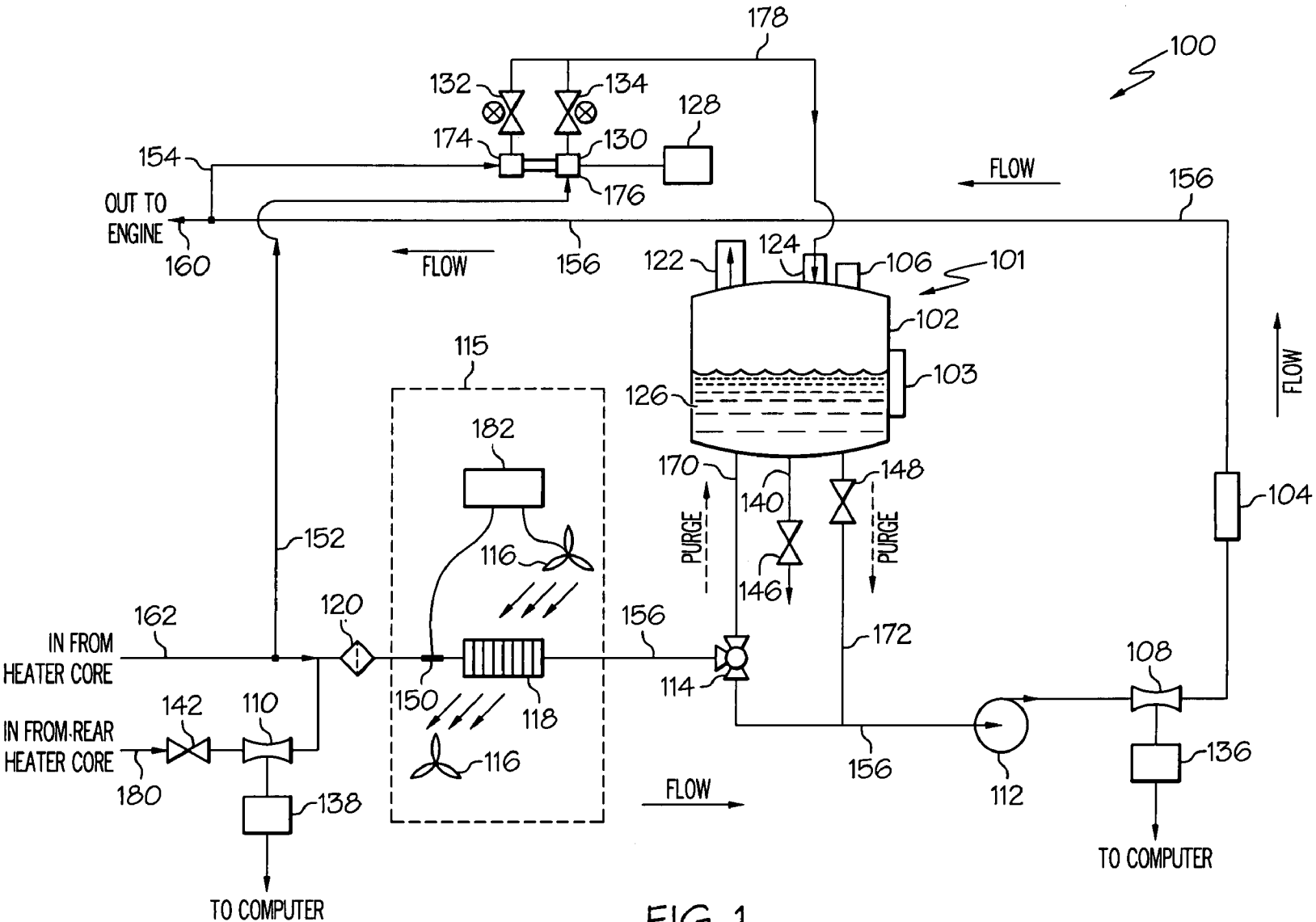
FIG. 1 is a schematic diagram of a coolant flow measurement device according to one or more embodiments shown and described herein.

FIG. 1 generally depicts one embodiment of a coolant flow measurement device for measuring the flow of coolant through the HVAC system of a vehicle. The coolant flow measurement device generally comprises a coolant reservoir, a coolant flow circuit, a variable speed fluid pump, a purge system, a flow meter, a cooling system and a differential pressure gage. The coolant flow measurement device may be connected to a component (e.g., the heater core, radiator, and/or engine) of the vehicle to measure the flow of coolant through the component. Various embodiments of the coolant flow measurement device, the components of the coolant flow measurement device and methods of using the coolant flow measurement device device will be described in more detail herein.

Referring now to FIG. 1, a coolant flow measurement device 100 is schematically depicted according to one embodiment described herein. The coolant flow measurement device generally comprises a purge system 101, a coolant flow circuit 156, a fluid pump 112, a flow meter 108, a cooling system 115 and a differential pressure gage 130. The coolant flow circuit 156 may comprise piping or tubing connected to form a continuous circuit such that, when the coolant flow measurement device 100 is connected to an HVAC system of a vehicle, the HVAC system of the vehicle and the coolant flow circuit 156 form a closed-loop circuit. Various other components of the coolant flow measurement device 100 are connected to the coolant flow circuit 156, as will be discussed in further detail herein.

To facilitate connection to the HVAC system of the vehicle, the coolant flow measurement device may comprise a device outlet 160 and a device inlet 162. The device outlet 160 and device inlet 162 may comprise fluid couplers, such as quick disconnect couplers or the like, that correspond to couplers on the HVAC system of the vehicle.

Figure 5:
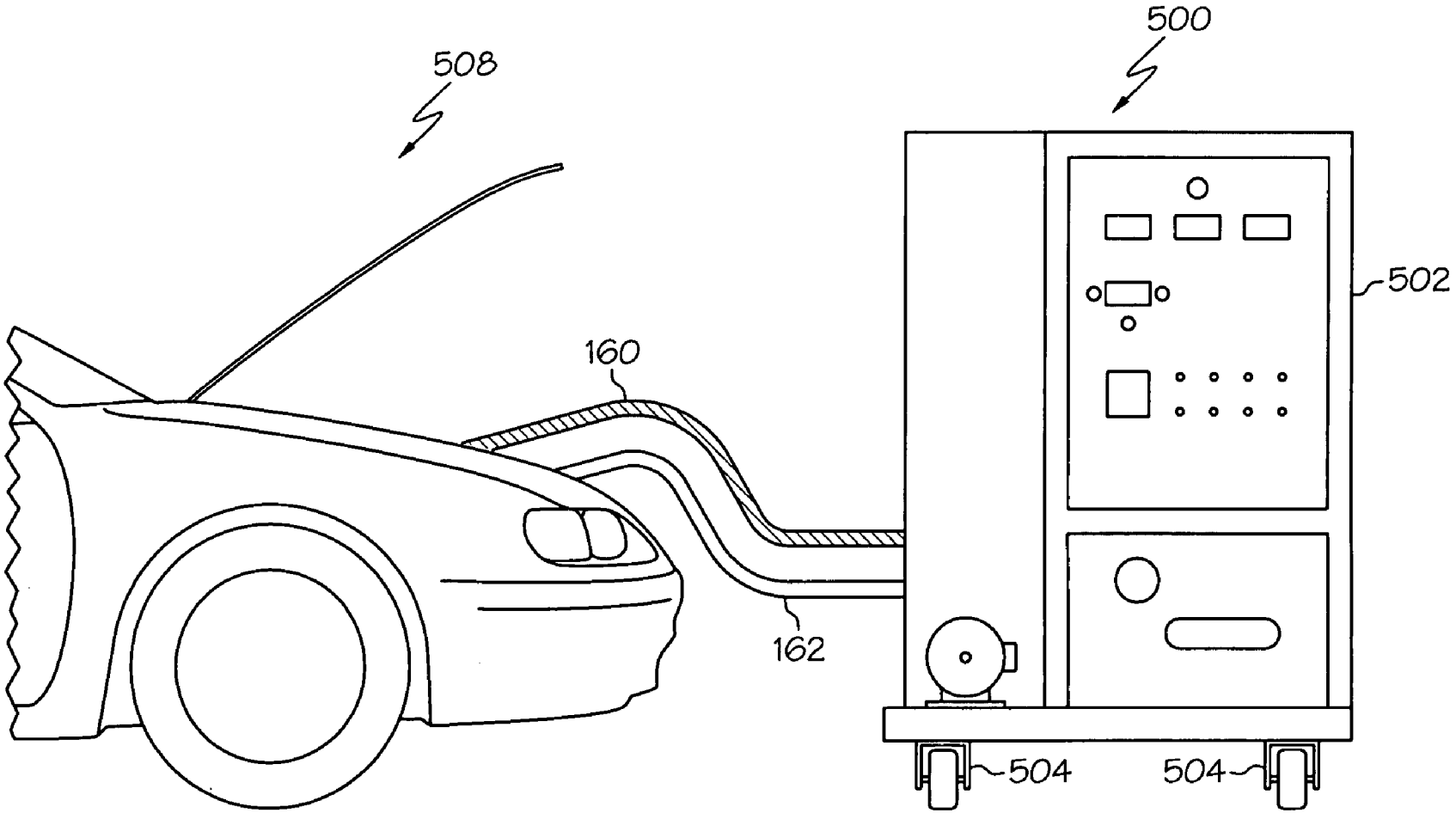
FIG. 5 schematically depicts a vehicle coupled to a test stand according to one or more embodiments shown and described herein.

Referring to FIG. 5, the coolant flow measurement device 100 depicted in FIG. 1, including the coolant flow circuit 156 and various components and controllers connected to the coolant flow circuit 156 may be housed in a bench test stand 500 or other assembly. The bench test stand 500 may comprise a cabinet 502 with casters 504 such that the coolant flow measurement device may be rolled or wheeled up to a vehicle 508 and connected to the HVAC system of the vehicle 508 using the fluid couples on the device outlet 160 and the device inlet 162.

Referring again to FIG. 1, the coolant flow measurement device 100 and the various components disposed along the coolant flow circuit 156 will now be described in more detail beginning from the device inlet 162 and generally following the pathway of coolant flow through the coolant flow circuit to the device outlet 160.

A filter 120 may be optionally disposed along the coolant flow circuit 156 for filtering particulate material from the coolant. The filter 120 may be a very low restriction filter such that the filter 120 has a minimal effect on the flow rate of coolant through the coolant flow measurement device 100. However, it should be understood that the filter 120 is optional and that the coolant flow measurement device 100 may be operable without the filter 120.

The coolant flow measurement device may comprise a cooling system 115 for regulating the temperature of coolant in the coolant flow measurement device 100. The cooling system may comprise a temperature sensor disposed in the coolant flow circuit 156 for determining the temperature of coolant in the coolant flow circuit 156. In one embodiment the temperature sensor comprises a thermocouple (not shown) disposed in a thermocouple well 150. The thermocouple may be electrically coupled to a temperature controller 182 which receives a signal from the thermocouple indicative of the coolant temperature.

The cooling system 115 may also comprise a radiator 118 disposed along the coolant flow circuit 156 such that coolant flows into and through the radiator 118. One or more cooling fans 116 may be disposed on either side of the radiator 118 to provide air flow through the radiator 118 and thereby reduce the heat content of the coolant flowing through the coolant flow circuit 156. While the embodiment shown in FIG. 1 depicts the coolant flow measurement device 100 as comprising cooling fans 116 positioned on either side of the radiator 118, it should be understood that the coolant flow measurement device 100 may comprise one cooling fan positioned on either side of the radiator 118 to draw or force air through the radiator 118.

The temperature controller 182 may also be electrically coupled to the cooling fan(s) 116. The temperature controller 182 may comprise a display where the temperature of the coolant is displayed. The temperature controller 182 may be programmed to maintain the coolant at a specified temperature. For example, the temperature controller 182 may be set to turn on the cooling fan(s) 116 when the coolant reaches a specified temperature thereby providing air flow through the radiator and cooling the coolant. Similarly, the temperature controller may be set to turn off the cooling fan(s) 116 when the coolant temperature drops below a specified temperature. The temperature controller 182 may comprise a manual override such that the cooling fans may be manually turned on and off either from the temperature controller 182 or, alternatively, via an attached controller (not shown).

While specific reference has been made herein to the cooling system 115 of the coolant flow measurement device 100 comprising a radiator 118, a temperature controller 182, cooling fan(s) 116 and a temperature sensor, it should be understood that the cooling system may, in the alternative, comprise other components to facilitate the cooling of coolant flowing in the coolant flow circuit. For example, instead of a radiator, the cooling system may comprise a heat exchanger, such as a fluid heat exchanger, for reducing the heat content of the cooling fluid. Accordingly, unless otherwise specified herein, no particular limitation is intended as to the cooling system 115 comprising a radiator, a temperature controller, cooling fan(s), a temperature controller and a temperature sensor.

The coolant flow measurement device 100 may also comprise a purge system 101 for purging air contained in the coolant flow measurement device 100 and coolant 126 flowing through the coolant flow measurement device 100. The purge system 101 may generally comprise a coolant reservoir 102 for containing coolant 126 delivered to the coolant system of the vehicle during the coolant flow measurement test. The coolant reservoir 102 may comprise a tank constructed of a metal or polymer material that will not degrade or corrode with exposure to the coolant 126. In the embodiment shown in FIG. 1, the coolant reservoir 102 comprises a cylindrical stainless steel tank although it should be understood that tanks of other geometrical configurations and materials may be used. The coolant reservoir 102 may be insulated such that the coolant reservoir is capable of maintaining the temperature of the coolant to within ±0.1° C. for coolant temperatures in the range of about −25° C. to about ±120° C.

The coolant reservoir 102 may comprise a filler neck 106 situated atop the coolant reservoir 102 to facilitate filling the coolant reservoir 102 with coolant. The filler neck 106 may comprise a filler cap (not shown), such as a radiator cap similar to those used in conjunction with the radiator of a vehicle, or a similar cap operable to vent excess pressure which may build in the coolant reservoir 102 and/or the coolant flow measurement device 100. The coolant reservoir 102 may also comprise an air vent 122 generally positioned atop the coolant reservoir 102 and a drain 140 generally positioned on or near the bottom of the coolant reservoir 102. The air vent 122 may be operable to vent air purged from the coolant flow measurement device. The flow of coolant 126 through the drain 140 and out of the coolant reservoir 102 (and the coolant flow measurement device 100) is regulated by a valve 146 fluidly coupled to the drain 140. The valve 146 may comprise a mechanical valve or an electromechanical valve. In one embodiment, when the valve 146 is an electromechanical valve, the valve 146 may be operatively connected to a controller (not shown) such that the valve 146 may be opened and closed using electrical signals sent to the valve 146 by the controller. When the valve 146 is open, coolant may drain from the coolant reservoir 102 and, when the valve is closed, the coolant is prevented from draining from the coolant reservoir 102.

The coolant reservoir 102 may also comprise a sight glass 103. The sight glass 103 may be positioned on a side of the coolant reservoir 102 such that the level of coolant contained in the coolant reservoir is visible through the sight glass 103. The sight glass 103 permits an operator of the coolant flow measurement device 100 to ascertain the level of the coolant in the coolant reservoir 102 and make a qualitative assessment as to the amount of air trapped in the coolant as the coolant flows in and out of the coolant reservoir 102.

The purge system 101 may also comprise a purge inlet 170 and a purge outlet 172 generally positioned near the bottom of the coolant reservoir 102 and fluidly connected to the coolant reservoir 102. The purge inlet 170 and the purge outlet 172 fluidly connect the coolant reservoir 102 to the coolant flow circuit 156. The purge inlet 170 is fluidly connected to the coolant flow circuit 156 with a 3-way switching valve 114 which enables coolant flowing through the coolant flow circuit 156 to be diverted from the coolant flow circuit 156 and into the coolant reservoir 102 of the purge system 101 via the purge inlet 170. The 3-way switching valve 114 may comprise a mechanical valve, an electromechanical valve, a pneumatically actuated valve or a similar valve. In the embodiment shown in FIG. 1, the 3-way switching valve 114 is a one inch diameter electromechanical valve having an open-close response time of six seconds and able to withstand an operating temperature of at least 150° C. The 3-way valve 114 is operatively connected to a controller (not shown) which facilitates opening and closing the valve by electrical signals sent to the 3-way valve 114.

The purge outlet 172 may have a tank outlet valve 148 disposed between the coolant reservoir 102 and the coolant flow circuit 156. The tank outlet valve 148 may be used to prevent the flow of coolant from the coolant reservoir 102 into the coolant flow circuit 156. The tank outlet valve 148 may comprise a mechanical valve, an electromechanical valve, a pneumatically actuated valve or a similar valve. In the embodiment shown in FIG. 1, the tank outlet valve 148 is a one-way valve which prevents coolant from flowing back into the coolant reservoir 102 from the coolant flow circuit 156 via the purge outlet 172. The tank outlet valve 148 and the 3-way switching valve 114 may be used in conjunction with one another to regulate the flow of coolant in to and out of the purge system 101 and thereby control the amount of air trapped in the coolant flow measurement device 100 and the attached vehicle HVAC system (not shown).

Still referring to FIG. 1, the coolant flow measurement device 100 may further comprise a variable speed fluid pump 112 fluidly coupled to the coolant flow circuit 156 between the purge outlet 172 and the device outlet 160. The variable speed fluid pump 112 receives coolant from the coolant flow circuit 156 and pumps the fluid through the coolant flow circuit 156 at a specific rate and/or pressure. The variable speed fluid pump 112 may comprise an electric fluid pump although it should be understood that other fluid pumps (e.g., mechanical, hydraulic, pneumatic, etc.) may be used. In the embodiment shown, the variable speed fluid pump 112 may comprise an electric fluid pump having a variable pump rate with a maximum pump rate of at least 15 L/min and a head pressure of 20 kPa. The variable speed fluid pump 112 may be operatively connected to a controller (not shown) such that the pump rate of the variable speed fluid pump 112 may be adjusted by using the controller to adjust the current and/or voltage supplied to the fluid pump 112.

The coolant flow measurement device 100 may also comprise a primary flow meter 108 disposed along the coolant flow circuit 156 between the fluid pump 112 and the device outlet 160. The primary flow meter 108 is fluidly connected to the coolant flow circuit 156 such that the coolant flowing through the coolant flow circuit passes through the primary flow meter 108. The primary flow meter 108 may comprise an electromagnetic flow meter, a turbine flow meter, a magnetic flow meter or a similar device used for measuring the rate of fluid flow. In the embodiment shown, the primary flow meter 108 comprises an electromagnetic flow meter having a maximum capacity of 30 liters/min and an accuracy of ±1.5% at a flow rate of 0.1 L/min. The turbine flow meter has an operating temperature range from about −25° C. to about 120° C. The primary flow meter 108 may be electrically coupled to a display 136 which displays the flow rate of coolant through the primary flow meter 108. The primary flow meter 108 may also be coupled to a computer (not shown) or a controller (not shown) such that the coolant flow rates measured by the primary flow meter 108 may be stored in a memory operatively associated with the computer or the controller.

The coolant flow measurement device 100 may also comprise a second sight glass 104 disposed along the coolant flow circuit 156 between the primary flow meter 108 and the device outlet 160. Coolant flowing through the coolant flow circuit 156 passes through the second sight glass 104 such that an operator of the coolant flow measurement device 100 may make a qualitative assessment of the amount of air flowing through the coolant flow circuit 156 along with the coolant.

In addition, the coolant flow measurement device 100 may also comprise a differential pressure gage 130 for determining the pressure difference between the device outlet 160 and the device inlet 162. In one embodiment, the differential pressure gage 130 generally comprises a differential pressure transducer comprising an outlet pressure transducer 174 and an inlet pressure transducer 176. The outlet pressure transducer 174 may be fluidly coupled to the device outlet 160 through the outlet pressure tap 154 while the inlet pressure transducer 176 may be fluidly coupled to the device inlet 162 through the inlet pressure tap 152. The outlet pressure transducer 174 may also be fluidly coupled to a bleed valve 132 which, in turn, may be fluidly coupled to a pressure relief line 178. Similarly, the inlet pressure transducer 176 may be fluidly coupled to a bleed valve 134 which, in turn, may also be fluidly coupled to a pressure relief line such as the pressure relief line 178 depicted in FIG. 1. The bleed valves 132, 134 may comprise mechanical valves or electromechanical valves. In the embodiment shown, the bleed valves 132, 134 comprise electromechanical bleed valves which may be manually operated. The pressure relief line 178 may be fluidly connected to the pressure relief connection 124 of the coolant reservoir 102 such that, when either of the bleed valves 132, 134 are opened, coolant flows through the pressure relief line 178 into the coolant reservoir 102 thereby reducing pressure in the coolant flow circuit 156 at either the device outlet 160, the device inlet 162 or both.

In operation, the differential pressure gage 130 determines the pressure difference between the device outlet 160 and the device inlet 162 using the inlet and outlet pressure transducers 174, 176. The differential pressure transducer 130 is operatively coupled to a display panel 128 where the difference in pressure between the device outlet 160 and the device inlet is displayed. An operator may use the bleed valves 132, 134 to bleed coolant from either or both of the device outlet 160 or the device inlet 162 to adjust the pressure differential between the device outlet 160 and the device outlet 162.

While the differential pressure gage 130 is described herein as comprising a pair of pressure transducers, it should be understood that the differential pressure gage 130 may comprise of mechanical pressure gages or similar gages for measuring fluid pressure.

In one embodiment, as shown in FIG. 1, the coolant flow measurement device 100 may optionally comprise a rear heater core inlet 180 for connecting the rear heater core outlet of a vehicle to the coolant flow measurement device. The rear heater core inlet 180 may be connected to the coolant flow circuit 156 between the device inlet 162 and the cooling system 115. The rear heater core inlet may comprise a valve 142 which closes the rear heater core inlet 180 thereby preventing fluid flow in to the coolant flow circuit 156 from the rear heater core inlet 180 or out of the coolant flow circuit 156 and into the rear heater core of the vehicle. The valve 142 may be a mechanical valve or an electromechanical valve. In the embodiment shown, the valve 142 is an electromechanical valve operatively connected to a controller (not shown) such that the valve may be opened and closed using electrical signals sent to the valve 142 via the controller. To facilitate attaching the rear heater core inlet 180 to the rear heater core outlet of the vehicle, the rear heater core inlet 180 may comprise a fluid couple, such as a quick disconnect couple or the like, which corresponds to the fluid couple on the rear heater core outlet of the vehicle.

A secondary flow meter 110 may be disposed between the rear heater core inlet and the coolant flow line 156. The secondary flow meter 110 may be fluidly connected to both the rear heater core inlet 180 and the coolant flow circuit 156 and operable to measure the flow rate of coolant coming into the coolant flow measurement device 100 from the rear heater core inlet 180. The secondary flow meter 110 may comprise an electromagnetic flow meter, a turbine flow meter, a magnetic flow meter or a similar device used for measuring the rate of fluid flow through the device. In the embodiment shown, the secondary flow meter 110 comprises a turbine flow meter having an accuracy of ±0.5% at a flow rate of 0.1 L/min. The electromagnetic flow meter has an operating temperature range from about −25° C. to about 120° C. The secondary flow meter 110 may be electrically coupled to a display 138 which displays the flow rate of coolant through the secondary flow meter 110. The secondary flow meter 110 may also be coupled to a computer (not shown) or a controller (not shown) such that the coolant flow rates measured by the secondary flow meter 110 may be stored in a memory operatively associated with the computer or the controller.

While FIG. 1 depicts the coolant flow measurement device 100 as comprising a rear heater core inlet 180, it should be understood that the rear heater core inlet is optional and that the coolant flow measurement device 100 may function without the rear heater core inlet 180. Moreover, it should also be understood that, when the coolant flow measurement device 100 comprises a rear heater core inlet 180, the valve 142 may be used to isolate the rear heater core inlet 180 from the coolant flow circuit 156 such that the coolant flow measurement device 100 operates without receiving any coolant from the rear heater core inlet.

The coolant flow measurement device 100 may also comprise an RPM meter or gage (not shown) for measuring the speed of the engine of the vehicle while the flow of coolant is measured. In one embodiment, the RPM meter may comprise a sensor which attaches to a plug wire of the engine of the vehicle and a display which indicates the speed of the engine based on the rate at which a spark plug attached to the plug wire fires. Alternatively, an RPM meter or gage may be attached to the engine crank. It should be understood that a variety of RPM meters and gages are available for both gasoline and diesel engines and that any such RPM meter and/or gage may be used in conjunction with the coolant flow measurement device 100 to determine the speed of the vehicle engine while the flow of coolant is measured.

The operation of the coolant flow measurement device 100 will now be described with reference to FIGS. 1-3. Initial set up of the coolant flow measurement device is performed by first prepping the vehicle to which the coolant flow measurement device will be attached. To prep the vehicle, the coolant is first drained from the HVAC system of the vehicle. The outlet hose of the front heater core is then disconnected from the front heater core and the engine coolant inlet. If the vehicle comprises a rear heater core, the outlet hose of the rear heater core may also be disconnected from the outlet of the rear heater core to facilitate measuring the coolant flow through the rear heater core. The outlet of the front heater core is fluidly connected to the device inlet 162 using quick disconnect fittings or other, similar fittings. The device outlet 160 is fluidly connected to the engine coolant inlet. When the vehicle comprises a rear heater core, the outlet of the rear heater core is connected to the rear heater core inlet 180 of the coolant flow measurement device 100. When the coolant flow measurement device 100 is attached to the HVAC system of the vehicle, the coolant flow circuit 156 and the HVAC system form a continuous loop and coolant may be pumped through the HVAC system with the coolant flow measurement device 100. An RPM gage or meter may be connected to the engine of the vehicle such that the speed of the engine may be determined during the coolant flow measurement.

With the coolant flow measurement device 100 connected to the vehicle, the coolant reservoir 102 of the purge system 101 may be filled with coolant 126. In the embodiments discussed herein, the coolant is a 50/50 mixture of coolant concentrate and water. Coolant 126 may be added to the coolant reservoir 126 until the level of coolant is visible through the sight glass 103. The coolant level in the coolant reservoir 102 should not, however, exceed the level of the sight glass 103 so that the level of level of coolant may be visually assessed throughout the coolant flow measurement procedure.

Figure 2:
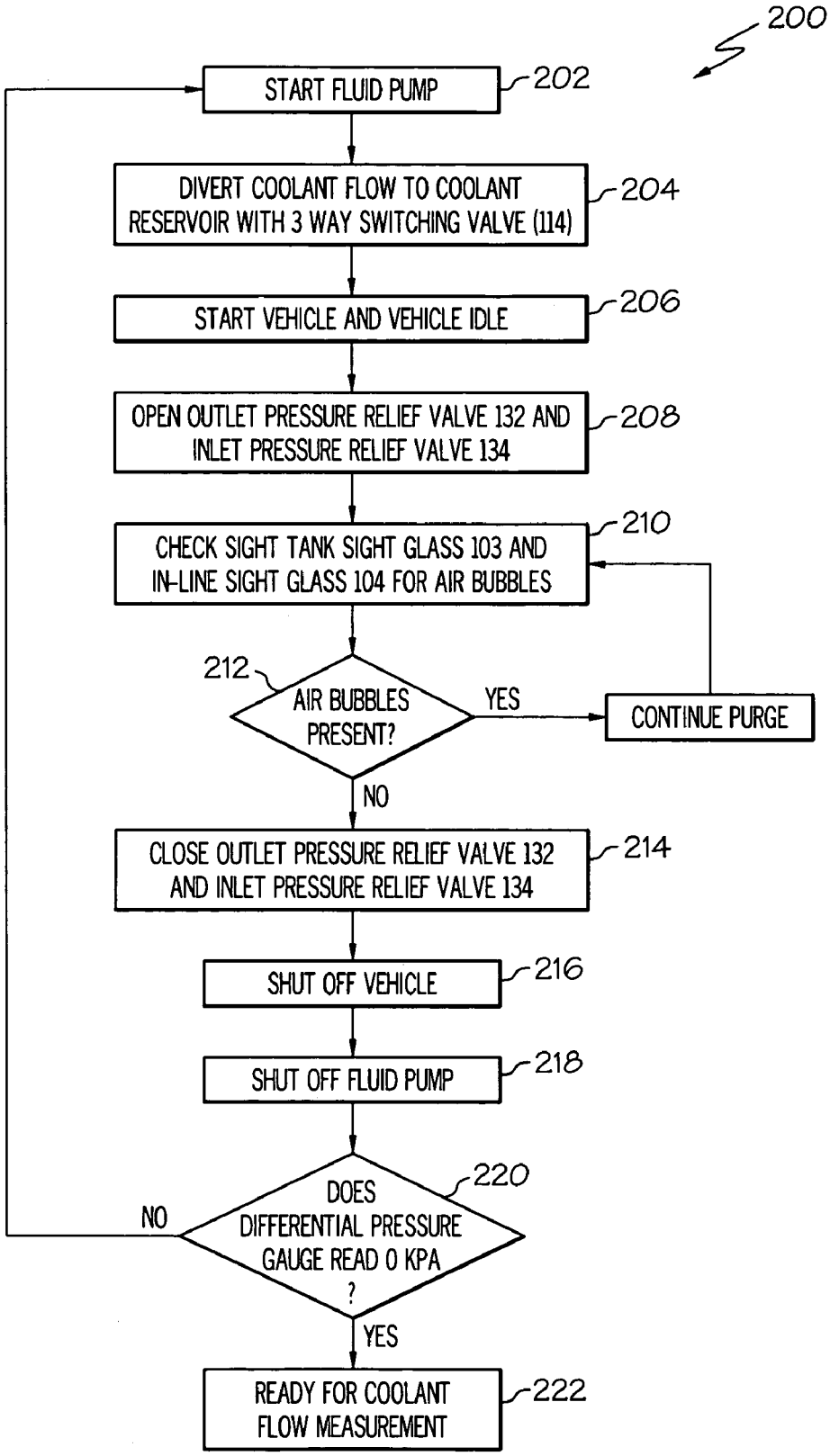
FIG. 2 is a flow diagram for purging air from the coolant flow measurement device and/or the HVAC system using a coolant flow measurement device shown and described herein.

Referring now to the flow diagram of FIG. 2, after the coolant flow measurement device 100 is connected to the vehicle and coolant 126 is added to the coolant reservoir 102, the coolant flow measurement device 100 and the HVAC system may be purged of air using the purge system 101 of the coolant flow measurement device and the purge procedure 200 shown in FIG. 2. In a first step 202, the fluid pump 112 is turned on to begin pumping coolant 126 from the coolant reservoir 102 and through the coolant flow circuit 156 and into the HVAC system of the vehicle. The coolant 126 is returned to the coolant flow measurement device via the device inlet 162 after circulating through the HVAC system of the vehicle. In step 204, the three-way switching valve 114 is set to divert coolant from the coolant flow circuit and into the coolant reservoir 102 of the purge system 101 via the purge inlet 170. In step 206, the vehicle is started and the engine of the vehicle is brought to an idle. In step 208, the outlet pressure relief valve 132 and the inlet pressure relief valve 134 are opened to bleed coolant back in to the coolant reservoir and thereby remove any air trapped in the pressure relief line 178.

As coolant 126 flows from the coolant flow circuit 156 and into the coolant reservoir 102, air trapped in the coolant flow circuit 156 and/or the HVAC system of the vehicle is also carried in to the coolant reservoir 102 where it is vented through the coolant reservoir air vent 122. Coolant 126 is then re-circulated back into the coolant flow circuit 156 through the purge outlet 172. In steps 210 and 212 the sight glass 103 of the coolant reservoir may be used to determine the presence of air bubbles in the coolant in the coolant reservoir 102. If air bubbles are visibly present in the coolant, the purge operation 200 continues. If there are no air bubbles visible in the coolant 126 in the coolant reservoir, the purge process continues to steps 214-220 where a quantitative determination is made as to the presence of air in the coolant flow measurement device and/or the HVAC system of the vehicle.

In step 214 the outlet pressure relief valve 132 and the inlet pressure relief valve 134 are closed. In step 216 the vehicle is shut off and, in step 218, the fluid pump 112 is shut off. In step 220, the pressure differential between the device inlet 162 and the device outlet 160 is measured with the pressure differential transducer 130. A pressure differential between the device inlet 162 and the device outlet 160 is indicative of air trapped in the coolant flow measurement device 100 and/or the HVAC system of the vehicle and the purge process 200 is re-started. However, if the pressure differential between the device inlet 162 and the device outlet 160 is zero, the coolant flow measurement device 100 and the HVAC system of the vehicle are free from trapped air and the coolant flow measurement device and the HVAC system of the vehicle are ready for measurement. The three-way switching valve 114 can then be set to divert coolant from the purge system 101 and into the coolant flow circuit 156.

Figure 3:
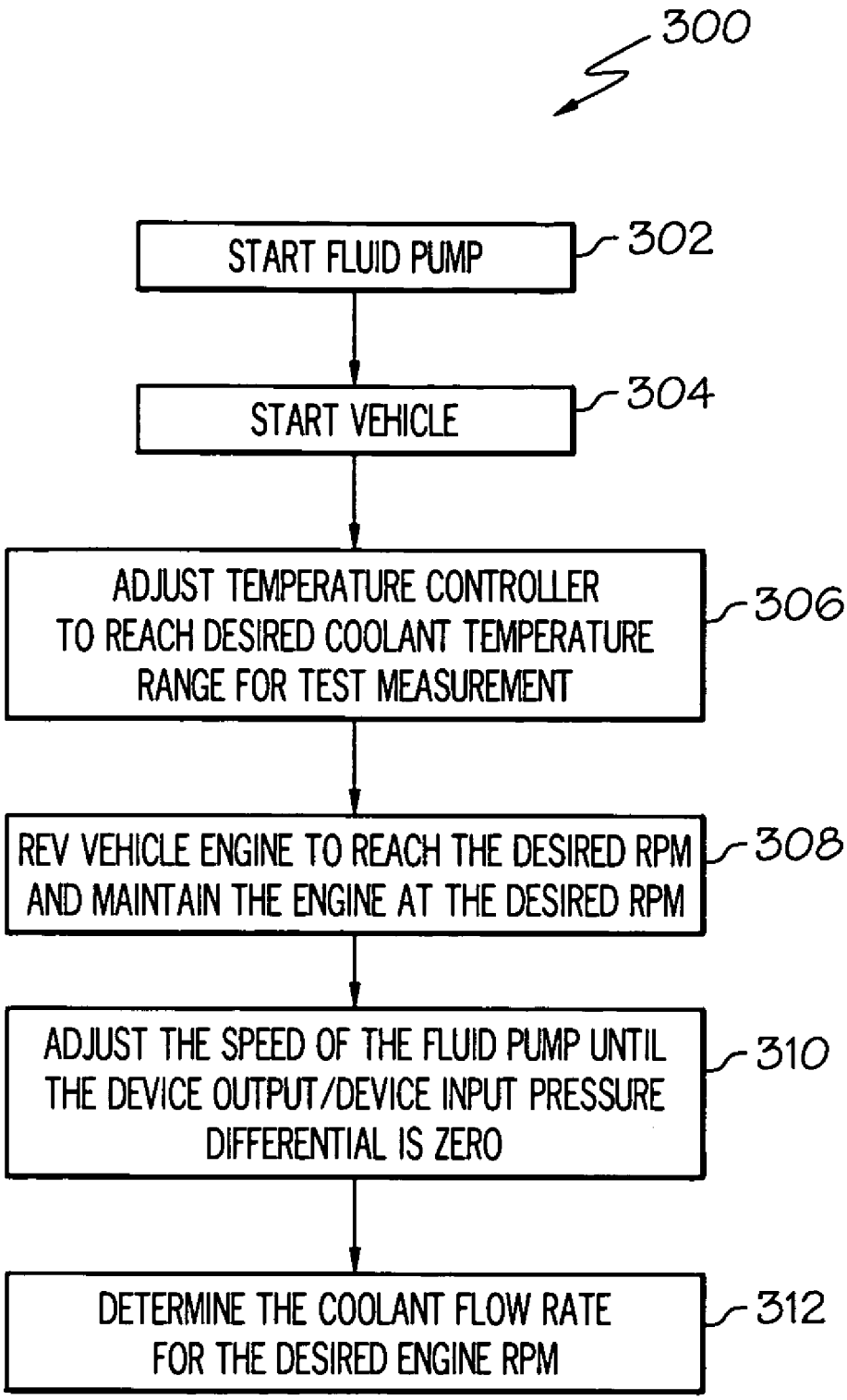
FIG. 3 is a flow diagram of a process for measuring the coolant flow through the HVAC system of a vehicle using the coolant flow measurement device according to one or more embodiments shown and described herein.

Referring now to FIGS. 1 and 3, one embodiment of a procedure 300 for performing the coolant flow measurement of a vehicle HVAC system using the coolant flow measurement device 100 is shown. In step 302 the fluid pump 112 is started such that coolant flows through the coolant flow circuit 156 and into the HVAC system of the vehicle. The sight glass 104 may be used to monitor the coolant for trapped air and/or debris which may inhibit the accuracy of the coolant flow measurement. In step 304 the vehicle connected to the coolant flow measurement device is started.

The measurement of the coolant flow through the HVAC system may be performed under two conditions: with the thermostat of the vehicle open or with the thermostat of the vehicle closed. The thermostat of the vehicle opens and closes depending on the temperature of the coolant. For example, thermostats in most vehicles will open when the coolant temperature is greater than about 85° C. Accordingly, in order to facilitate measurement of the coolant flow under both conditions, the temperature of the coolant must be maintained at a temperature either above or below the thermostat opening temperature depending on the desired measurement condition. Maintaining the coolant above or below the desired thermostat temperature may be accomplished by using the temperature controller 182 coupled to the radiator 118 to switch on and off the cooling fan(s) 116. Accordingly, in step 306, the temperature controller 182 may be adjusted and/or set to maintain the coolant temperature in a desired range corresponding to the thermostat of the vehicle being either open or closed.

When a "thermostat closed" measurement is desired, the temperature controller 182 may be used to manually switch on the cooling fan(s) 116 (e.g., the cooling fan(s) remain switched on irrespective of the temperature of the coolant flowing through the radiator 118). Alternatively, the temperature controller 182 may be set with upper and lower set points such that the cooling fans 116 are switched on and off at the set points thereby maintaining the coolant temperature between the upper and lower and set points. For example, for a thermostat opening temperature of about 85° C., the lower set point may be 70° C. and the upper set point may be 80° C. such that the temperature controller 182 switches the cooling fan(s) 116 on at 80° C. and switches the cooling fan(s) 116 off at 70° C. thereby maintain the coolant temperature between 70° and 80° C. Once the temperature of the coolant is below about 80° C. as determined by the thermocouple positioned in the thermocouple well 150 proximate the device inlet 162, the thermostat of the vehicle is closed and the coolant flow measurement for the "thermostat closed" condition may be performed.

When a "thermostat open" measurement is desired, the temperature controller 182 may be used to manually switch off the cooling fans 116 thereby allowing the coolant temperature to increase to greater than about the thermostat opening temperature such that the thermostat of the vehicle is open. Alternatively, the temperature controller 182 may be programmed with upper and lower set points to switch the cooling fans 116 on and off and thereby maintain the temperature of the coolant in a predetermined range. For example, for a thermostat opening temperature of about 85° C., the upper set point of the temperature controller 182 may be 95° C. while the lower set point may be 88° C. Accordingly, the cooling fans will be switched on at 95° C. and switched off at 88° C. such that the temperature of the coolant is maintained between about 88° C. and about 95° C. Once the temperature of the coolant is above about 85° C. as determined by the thermocouple positioned in the thermocouple well 150 proximate the device inlet 162, the thermostat of the vehicle is open and the coolant flow measurement for the "thermostat open" condition may be performed.

Once the coolant is in the desired temperature range (e.g., once the vehicle thermostat is either open or closed), the engine of the vehicle may be revved to reach a desired speed, as determined by the RPM meter or gage attached to the engine of the vehicle. In one embodiment, the engine of the vehicle is revved by depressing the accelerator pedal of the vehicle. In another embodiment, the engine of the vehicle may be revved using a controller operatively attached to the electronic throttle of the engine. Once the desired engine speed is reached, the accelerator pedal or throttle is set to maintain the engine speed.

In a next step 310, after the desired engine speed is reached, the rotational speed of the fluid pump 112 is adjusted such that the pressure differential between the device input 162 and the device output 160 is zero as determined by the differential pressure transducer 130. When the fluid pump is an electric fluid pump, the speed of the fluid pump 112 may be adjusted by using a controller, such as a potentiometer, operatively coupled to the pump to adjust the voltage supplied to the fluid pump.

Once the speed of the fluid pump 112 is adjusted such that the pressure differential between the device inlet 162 and the device outlet 160 is zero, the coolant flow rate for the particular engine speed may be determined from the display 136 of the primary flow meter 108. In one embodiment, where both the front heater core and the rear heater core of a vehicle are attached to the coolant flow measurement device 100, the primary flow meter may be used to determine the total flow rate of coolant through both the front heater core and the rear heater core while the secondary flow meter may be used to determined the flow rate of coolant through the rear heater core only.

Once the coolant flow measurement(s) are obtained for the desired engine speed, steps 308-312 may be repeated for different engine speeds and/or vehicle thermostat positions thereby characterizing the coolant flow through the HVAC system for a range of operating conditions.

Figure 4:
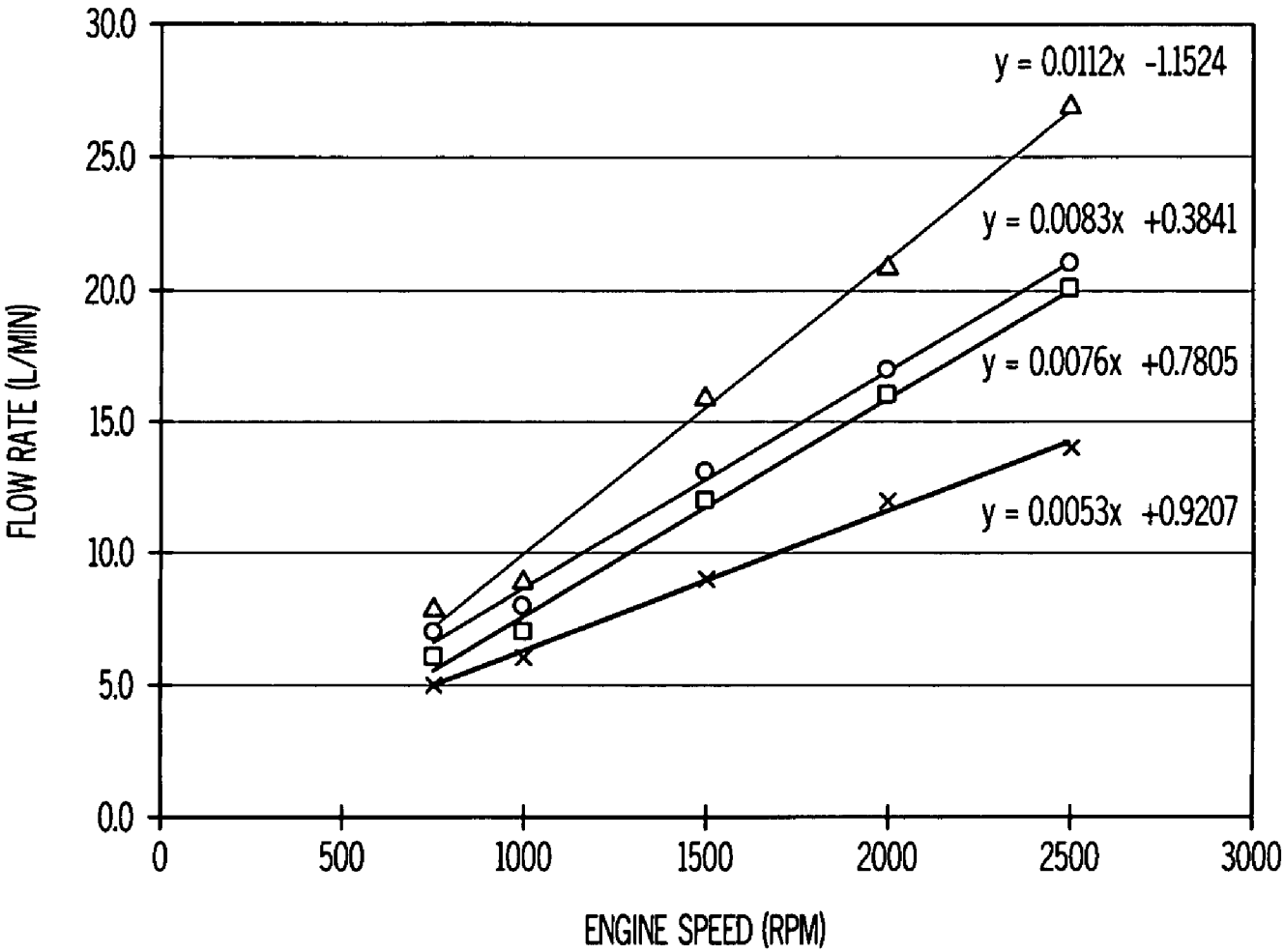
FIG. 4 is a plot of coolant vs. vehicle engine speed for various operating conditions as measured by the coolant flow measurement device according to one or more embodiments shown and described herein.

The coolant flow rates determined during the test measurement may be plotted against the corresponding engine speed for various test conditions as is shown in FIG. 4 which depicts a plot of engine speed (x-axis) vs. coolant flow rate (y-axis) for various test conditions. More specifically, FIG. 4 shows the coolant flow rate as a function of engine speed for a vehicle with both a front heater core and a rear heater core under various conditions. For example, the "x" markers show the coolant flow rate for the front heater core only with the thermostat open. The "□" markers show the coolant flow rate for the front heater core only with the thermostat closed. The "○" markers show the combined coolant flow rate for both the front heater core and the rear heater core with the thermostat open. The "Δ" markers show the combined coolant flow rate for both the front heater core and the rear heater core with the thermostat closed.

As shown in FIG. 4, a line or curve may be fit through the points and an equation for the line or curve may be determined using standard curve fitting and/or graphical analysis techniques. For example, the points plotted in FIG. 4 have been fitted with lines and the slope and y-intercept of each line have been determined. Using the equation of the line, a value for the coolant flow rate may be determined for different engine speeds. For example, referring to the "x" markers, the line fit through the markers corresponds to the equation $y=0.0053x+0.9207$ where 0.0053 is the slope of the line and 0.9207 is the y-axis intercept. Using this mathematical relationship, various engine speeds may be substituted for x to solve for the corresponding coolant flow rate y for the specific vehicle operating conditions.

Further, by plotting the coolant flow rate vs. engine speed for various vehicle operating conditions, the coolant flow through the system and, therefore, the cooling capacity or performance of the HVAC system of the vehicle, may be characterized or benchmarked. Such information may be used to analyze and improve the design of the HVAC system.

It should now be understood that the coolant flow measurement device shown and described herein may be used to measure the coolant flow through the HVAC system of a vehicle. The air purge system and fluid pump of the coolant flow measurement device facilitate balancing the pressure between the outlet of the device and the inlet of the device during operation which improves the accuracy and repeatability of coolant flow measurements made with the device.

Further, the radiator, in conjunction with the temperature controller and the cooling fans, facilitates controlling and regulating the temperature of the coolant during the coolant flow measurement which, in turn, enables the position of the thermostat of the vehicle to be controlled during the measurement. This yields greater accuracy in the measurement as the coolant flow through the HVAC system may be independently measured for each condition (e.g., with the vehicle thermostat open and with the vehicle thermostat closed).

For purposes of describing and defining the present invention it is noted that the terms "substantially" and "about" are utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A coolant flow measurement device comprising a coolant flow circuit, a cooling system, a purge system, a variable speed fluid pump, a differential pressure gage and a primary flow meter wherein:

the coolant flow circuit comprises a device outlet operable for attachment to an engine coolant flow inlet of a vehicle and a device inlet operable for attachment to a front heater core outlet of the vehicle such that coolant may be circulated from the coolant flow circuit into the engine coolant flow inlet, through an HVAC system of the vehicle and back into the coolant flow circuit;

the cooling system is fluidly connected to the coolant flow circuit proximate the device inlet such that coolant flowing into the device inlet passes through the cooling system, wherein the cooling system is operable to regulate the temperature of the coolant flowing through the coolant flow circuit;

the purge system is fluidly connected to the coolant flow circuit such that coolant flowing through the coolant flow circuit may be diverted into the purge system and back into the coolant flow circuit, wherein the purge system is operable to purge air from the coolant flow circuit;

the variable speed fluid pump is fluidly connected to the coolant flow circuit such that coolant flowing through the coolant flow circuit passes through the variable speed fluid pump, wherein the variable speed fluid pump is operable to balance a pressure of the coolant between the device inlet and the device outlet;

the primary flow meter is fluidly connected to the coolant flow circuit such that coolant flowing through the coolant flow circuit passes through the primary flow meter, wherein the primary flow meter is operable to measure a flow rate of coolant flowing through the coolant flow circuit; and the differential pressure gage is fluidly connected to the coolant flow circuit proximate the device inlet and the device outlet, wherein the differential pressure gage is operable to measure a pressure differential between the device inlet and the device outlet.

2. The coolant flow measurement device of claim 1 wherein the cooling system comprises a radiator, a cooling fan, a temperature controller and a temperature sensor, wherein:

the radiator is fluidly connected to the coolant flow circuit such that coolant flowing through the coolant flow circuit flows through the radiator;

the temperature sensor is positioned in the coolant flow circuit between the device inlet and the radiator and is operable to detect a temperature of the coolant flowing through the coolant flow circuit;

the cooling fan is positioned proximate the radiator and is operable to provide air flow through the radiator;

the temperature controller is electrically coupled to the cooling fan and the temperature sensor and is operable to switch the cooling fan on and off based on the detected temperature of the coolant.

3. The coolant flow measurement device of claim 2 wherein the temperature sensor comprises a thermocouple positioned in a thermocouple well disposed along the coolant flow circuit.

4. The coolant flow measurement device of claim 1 wherein the purge system comprises a coolant reservoir comprising a purge inlet, a purge outlet, a sight glass, a filler neck and an air vent wherein:

the filler neck is positioned atop the coolant reservoir and facilitates filling the coolant reservoir with coolant;

the air vent is positioned atop the coolant reservoir and facilitates venting air from the coolant reservoir;

the purge inlet and the purge outlet are positioned on a bottom of the coolant reservoir and fluidly connect the coolant reservoir with the coolant flow circuit wherein:

the purge inlet is fluidly connected to the coolant flow circuit with a three-way switching valve such that coolant flowing in the coolant flow circuit may be diverted from the coolant flow circuit and into the coolant reservoir with the 3-way switching valve; and the purge outlet is fluidly connected to the coolant flow circuit with a one-way valve such that coolant may flow out of the coolant reservoir and into the coolant flow circuit.

5. The coolant flow measurement device of claim 4 wherein the coolant reservoir further comprises a sight glass disposed on a side of the coolant reservoir.

6. The coolant flow measurement device of claim 1 wherein the differential pressure gage comprises an inlet pressure transducer and an outlet pressure transducer wherein:

the differential pressure gage is fluidly connected to the device outlet with an outlet pressure tap extending between the device outlet and the outlet pressure transducer; and the differential pressure gage is fluidly connected to the device inlet with an inlet pressure tap extending between the device inlet and the inlet pressure transducer.

7. The coolant flow measurement device of claim 6 wherein the inlet pressure transducer and the outlet pressure transducer are fluidly connected to the purge system by a pressure relief line wherein a bleed valve is disposed between the outlet pressure transducer and the pressure relief line and a bleed valve is disposed between the inlet pressure transducer and the pressure relief line.

8. The coolant flow measurement device of claim 1 wherein the pressure differential gage is electrically coupled to a display panel operable to display the measured pressure differential between the device inlet and the device outlet.

9. The coolant flow measurement device of claim 1 wherein the primary flow meter is electrically coupled to a display operable to display the flow rate of coolant through the coolant flow circuit.

10. The coolant flow measurement device of claim 1 further comprising a sight glass fluidly coupled to the coolant flow circuit.

11. The coolant flow measurement device of claim 1 further comprising a filter fluidly connected to the coolant flow circuit.

12. A coolant flow measurement device comprising a coolant flow circuit, a purge system, a radiator, a cooling fan a temperature controller, a thermocouple, a variable speed fluid pump, a electromagnetic flow meter and a differential pressure transducer, wherein:

the coolant flow circuit comprises a device outlet, a device inlet and a rear heater core inlet, wherein:

the device outlet is operable for attachment to the engine coolant flow inlet of the vehicle;

the device inlet is operable for attachment to the front heater core outlet of the vehicle; and the rear heater core inlet is operable for attachment to the rear heater core outlet of the vehicle such that coolant may flow from the coolant flow circuit into the engine coolant flow inlet, through the HVAC system of the vehicle and back into the coolant flow circuit;

the radiator is fluidly connected to the coolant flow circuit such that coolant flowing through the coolant flow circuit flows through the radiator;

the thermocouple is positioned in a thermocouple well disposed in the coolant flow circuit between the device inlet and the radiator and is operable to detect a temperature of the coolant flowing through the coolant flow circuit;

the cooling fan is positioned proximate the radiator and is operable to provide air flow through the radiator;

the temperature controller is electrically coupled to the cooling fan and the thermocouple and is operable to switch the cooling fan on and off based on the detected temperature of the coolant;

the purge system is fluidly coupled to the coolant flow circuit with a three-way switching valve and a one-way check valve such that fluid flowing through the coolant flow circuit may be diverted into the purge system with the three-way switching valve and coolant may flow out of the purge system and back into the coolant flow circuit through the one-way check valve;

the variable speed fluid pump is fluidly connected to the coolant flow circuit such that coolant flowing through the coolant flow circuit passes through the variable speed fluid pump, wherein the variable speed fluid pump is operable to balance a pressure of the coolant between the device inlet and the device outlet;

the electromagnetic flow meter is fluidly connected to the coolant flow circuit such that coolant flowing through the coolant flow circuit passes through the electromagnetic flow meter, wherein the electromagnetic flow meter is operable to measure a flow rate of coolant flowing through the coolant flow circuit;

the differential pressure transducer is fluidly connected to the coolant flow circuit proximate the device inlet and the device outlet, wherein the differential pressure transducer is operable to measure a pressure differential between the device inlet and the device outlet.

13. The coolant flow measurement device of claim 12 wherein the purge system comprises a coolant reservoir comprising a filler neck, an air vent, a sight glass and a drain wherein:

the filler neck is positioned atop the coolant reservoir and facilitates filling the coolant reservoir with coolant;

the air vent is positioned atop the coolant reservoir and facilitates venting air from the coolant reservoir;

the sight glass is disposed on a side of the coolant reservoir; and the drain is positioned on a bottom of the coolant reservoir and comprises a drain valve for opening and closing the drain.

14. The coolant flow measurement device of claim 12 wherein:

the differential pressure transducer is electrically coupled to a display operable to display the measured pressure differential between the device inlet and the device outlet; and the differential pressure transducer comprises an inlet pressure transducer and an outlet pressure transducer wherein:

the differential pressure gage is fluidly connected to the device outlet with an outlet pressure tap extending between the device outlet and the outlet pressure transducer; and the differential pressure gage is fluidly connected to the device inlet with an inlet pressure tap extending between the device inlet and the inlet pressure transducer.

15. The coolant flow measurement device of claim 14 wherein the inlet pressure transducer and the outlet pressure transducer are fluidly connected to the purge system by a pressure relief line wherein a bleed valve is disposed between the outlet pressure transducer and the pressure relief line and a bleed valve is disposed between the inlet pressure transducer and the pressure relief line.

16. The coolant flow measurement device of claim 12 wherein the primary flow meter is electrically coupled to a display operable to display the flow rate of coolant through the coolant flow circuit.

17. The coolant flow measurement device of claim 12 wherein the rear heater core inlet further comprises a secondary flow meter fluidly connected to the rear heater core inlet, wherein the turbine flow meter is operable to measure the flow of coolant through the rear heater core inlet.

18. A method for measuring coolant flow through an HVAC system of a vehicle with a coolant flow measurement device comprising a coolant flow circuit, a cooling system, a purge system, a variable speed fluid pump, a differential pressure gage and a primary flow meter, wherein the cooling system, the purge system, the variable speed fluid pump, the differential pressure gage and the primary flow meter are fluidly connected to the coolant flow circuit of the coolant flow measurement device, the method comprising:

connecting a device outlet of the coolant flow circuit with an engine coolant flow inlet of the HVAC system of the vehicle and connecting a device inlet of the coolant flow circuit with a front heater core inlet of the HVAC system of the vehicle;

flowing coolant from the coolant flow circuit and through the HVAC system of the vehicle and back into the coolant flow circuit with the variable speed fluid pump;

purging air from the coolant flow circuit with the purge system of the coolant flow measurement device until the pressure differential between the device outlet and the device inlet is zero as determined by the pressure differential gage of the coolant flow measurement device;

adjusting the temperature of coolant flowing through the coolant flow system with the cooling system of the coolant flow measurement device to reach a desired coolant temperature;

revving an engine of the vehicle to a desired engine speed;

adjusting a speed of the variable speed fluid pump at the desired engine speed until the pressure differential between the device outlet and the device inlet is zero as determined by the pressure differential gage of the coolant flow measurement device;

measuring the flow rate of coolant through the coolant flow circuit with the primary flow meter at the desired engine speed and the desired coolant temperature, wherein the measured flow rate of coolant through the primary flow circuit is the flow rate of coolant through the HVAC system of the vehicle.

19. The method of claim 18 further comprising connecting a rear heater core inlet of the coolant flow circuit of the coolant flow measurement device to a rear heater core outlet of the HVAC system of the vehicle.

20. The method of claim 19 wherein:

the rear heater core inlet is fluidly coupled to a secondary flow meter; and the method further comprises measuring the flow rate of coolant through the rear heater core inlet with the secondary flow meter, wherein the measured flow rate of coolant through the rear heater core inlet is the flow rate of coolant through a rear heater core of the vehicle.

* * * * *